US007665435B2

(12) United States Patent
Imazato et al.

(10) Patent No.: US 7,665,435 B2
(45) Date of Patent: Feb. 23, 2010

(54) INTERNAL COMBUSTION ENGINE PROVIDED WITH CAMSHAFT-DRIVEN ACCESSORY

(75) Inventors: Aritoshi Imazato, Saitama (JP); Kazuaki Shimoyama, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 193 days.

(21) Appl. No.: 11/729,985

(22) Filed: Mar. 30, 2007

(65) Prior Publication Data

US 2007/0240671 A1 Oct. 18, 2007

(30) Foreign Application Priority Data

Apr. 18, 2006 (JP) ..... 2006-114971

(51) Int. Cl.
*F01L 1/02* (2006.01)
*F02F 1/42* (2006.01)

(52) U.S. Cl. ..... 123/90.27; 123/193.5; 123/198 R

(58) Field of Classification Search ..... 123/198 R, 123/198 E, 90.16, 90.17, 90.27, 90.31, 90.6, 123/195 R, 195 A, 193.5, 198 C
See application file for complete search history.

(56) References Cited

U.S. PATENT DOCUMENTS 5,184,581 A * 2/1993 Aoyama et al. ..... 123/90.31
5,839,401 A * 11/1998 Gruber et al. ..... 123/90.31
5,957,104 A * 9/1999 Ohsawa ..... 123/193.5
6,148,787 A * 11/2000 Takano ..... 123/195 A
6,895,942 B2 * 5/2005 Iitaka et al. ..... 123/509
6,953,015 B2 * 10/2005 Asari et al. ..... 123/90.27

FOREIGN PATENT DOCUMENTS

JP 2000-080968 A 3/2000

* cited by examiner

*Primary Examiner*—Noah Kamen
(74) *Attorney, Agent, or Firm*—Arent Fox LLP

(57) ABSTRACT

An internal combustion engine has a camshaft holder 20 attached to a cylinder head 1, and two camshafts 11 and 12 are rotatably supported by the camshaft holder 20. A high-pressure pump 60 has a driving shaft 63 rotatively driven by the camshaft. An accessory holder 30 provided with a mounting seat 40 to which the high-pressure fuel pump 60 is attached is formed integrally with a lower camshaft holder 21 included in the camshaft holder 20. The mounting seat 40 is formed integrally with the accessory holder 30 and is provided with a through hole 41 in which the driving shaft 63 is received. Thus the cylinder head 1 is formed in a small size and a light weight. The accessory holder 30 can be formed with a high rigidity in a small size.

5 Claims, 7 Drawing Sheets

INTERNAL COMBUSTION ENGINE PROVIDED WITH CAMSHAFT-DRIVEN ACCESSORY

BACKGROUND OF THE INVENTION

1. Field of the Invention

The present invention relates to an internal combustion engine provided with a camshaft holder rotatably supporting a camshaft or camshafts included in a valve train and attached to a cylinder head, and an accessory or auxiliary machinery rotatively driven by the camshaft and, more specifically, to the construction of an accessory holder mounted on the camshaft holder to hold an accessory.

2. Description of the Related Art

In an internal combustion engine provided with an accessory rotatively driven by a camshaft included in a valve train, the accessory is attached to a mounting seat formed on a cylinder head, on which a camshaft is supported for rotation, with its driving shaft interlocked with the camshaft passed through a through hole formed in the mounting seat. Such an arrangement is disclosed in JP-A 2000-80968.

The mounting seat for the accessory driven by the camshaft additionally formed in the cylinder head which is integrally provided with a camshaft support part for supporting the camshaft enlarges the cylinder head. Such a cylinder head formed by casting is likely to have a dead material and a large weight. The mounting seat formed integrally with the cylinder head protrudes upward from the joining surface of the cylinder head to which the joining surface of the cylinder head cover or valve cover is joined. Therefore, much finishing work needed to form the joining surface accurately increases the manufacturing cost of the cylinder head.

If torque necessary for rotating the camshaft is caused to vary by the operation of the accessory, it is desirable not to promote the variation of the torque resulting from the valve opening operation of the valve train for opening the valves of the internal combustion engine.

SUMMARY OF THE INVENTION

The present invention has been made in view of the foregoing problem and it is therefore an object of the present invention to reduce the size and weight of a cylinder head and to increase the rigidity of an accessory holder for holding an accessory without forming the accessory holder in a large size. Another object of the present invention is to finish the joining surface of a cylinder head to which a valve cover is joined in a high accuracy at a low cost and to reduce a maximum value in varying torque needed to rotate a camshaft and varying according to the operating condition of an accessory driven by the camshaft.

An internal combustion engine according to the present invention comprises: a cylinder head provided with a camshaft holder rotatably supporting camshaft means included in a valve train for operating engine valves; and accessory means rotatively driven by the camshaft means; wherein the accessory means has driving shaft means interlocked with the camshaft means, the camshaft holder is provided with an accessory holder having mounting seat means on which the accessory means is mounted, and the mounting seat means is formed integrally with the accessory holder and is provided with through hole means into which at least either of the camshaft means and the driving shaft means is inserted.

According to the present invention, the accessory holder provided with the mounting seat means is formed integrally with the camshaft holder separate from the cylinder head.

Therefore, the cylinder head can be formed in a small size and small weight. The accessory holder is supported by the camshaft holder on the cylinder head. Therefore, the accessory holder having a high rigidity does not need to be formed in a large size and the accessory holder having a high rigidity can stably hold accessories. Since through hole means is formed in the mounting seat means formed on the accessory holder, the through hole means, as compared with those formed in a split member, can be easily sealed.

Preferably, the accessory holder is attached to a mounting surface flush with a joining surface of the cylinder head to which a valve cover is joined.

Since the accessory holder is attached to the mounting surface flush with the joining surface of the cylinder head, the joining surface of the cylinder head can be contained in a plane and can be easily finished with high accuracy. Thus the joining surface can be sealed at a low cost.

Preferably, the accessory holder is formed integrally with the camshaft holder integrally provided with a plurality of bearing parts for supporting the camshaft means.

Since the accessory holder is formed integrally with the camshaft holder, the accessory holder having a high rigidity can be formed in a small size and a small weight.

Typically, the camshaft means includes first and second camshafts, the accessory means includes first and second accessories, the driving shaft means includes first and second driving shafts interlocked respectively with the first and the second camshaft, the mounting seat means includes first and second mounting seats to which the first and the second accessories are attached, respectively, and the through hole means includes a first through hole in which at least either of the first camshaft and the first driving shaft is received and a second through hole in which at least either of the second camshaft and the second driving shaft is received.

The two mounting seats on which the two accessories are mounted, respectively, are formed in the single accessory holder. Therefore, the rigidity of the accessory holder is higher than those of accessory holders respectively provided with mounting seats for individually holding the accessories.

Preferably, the accessory is a fuel pump. The number of cycles of a fuel discharge operation performed by the fuel pump to discharge fuel every one turn of the camshaft is equal to the number of cycles of a valve opening operation performed by the valve train to open the valves, and the camshaft and the driving shaft are connected such that peaks in varying torque exerted on the camshaft by the valve opening operation and peaks in varying torque exerted on the camshaft by the discharge operation of the fuel pump appear at different phases, respectively.

Since peaks in the varying torque exerted on the camshaft by the fuel pump discharge operation and those in varying torque exerted on the camshaft by the valve opening operation are out of phase with each other. Thus the absolute value of the amplitude of the varying torque acting on the camshaft means can be reduced and, hence the weight of the camshaft means having a necessary rigidity can be reduced.

The camshaft holder may include a lower camshaft holder attached to the cylinder head and an upper camshaft holder detachably attached to the lower camshaft holder, and the lower and the upper camshaft holder may be provided respectively with lower bearing parts and upper bearing parts forming the plurality of bearing parts.

The lower camshaft holder may include a central frame extending along the camshaft means, and two side frames extending along the central frame respectively on the opposite sides of the central frame.

The accessory holder may be formed integrally with an end part of the lower camshaft holder. The accessory holder may be a protrusion having a flat shape.

DESCRIPTION OF THE PREFERRED EMBODIMENTS

A preferred embodiment of the present invention will be described with reference to FIGS. 1 to 7.

Figure 1:
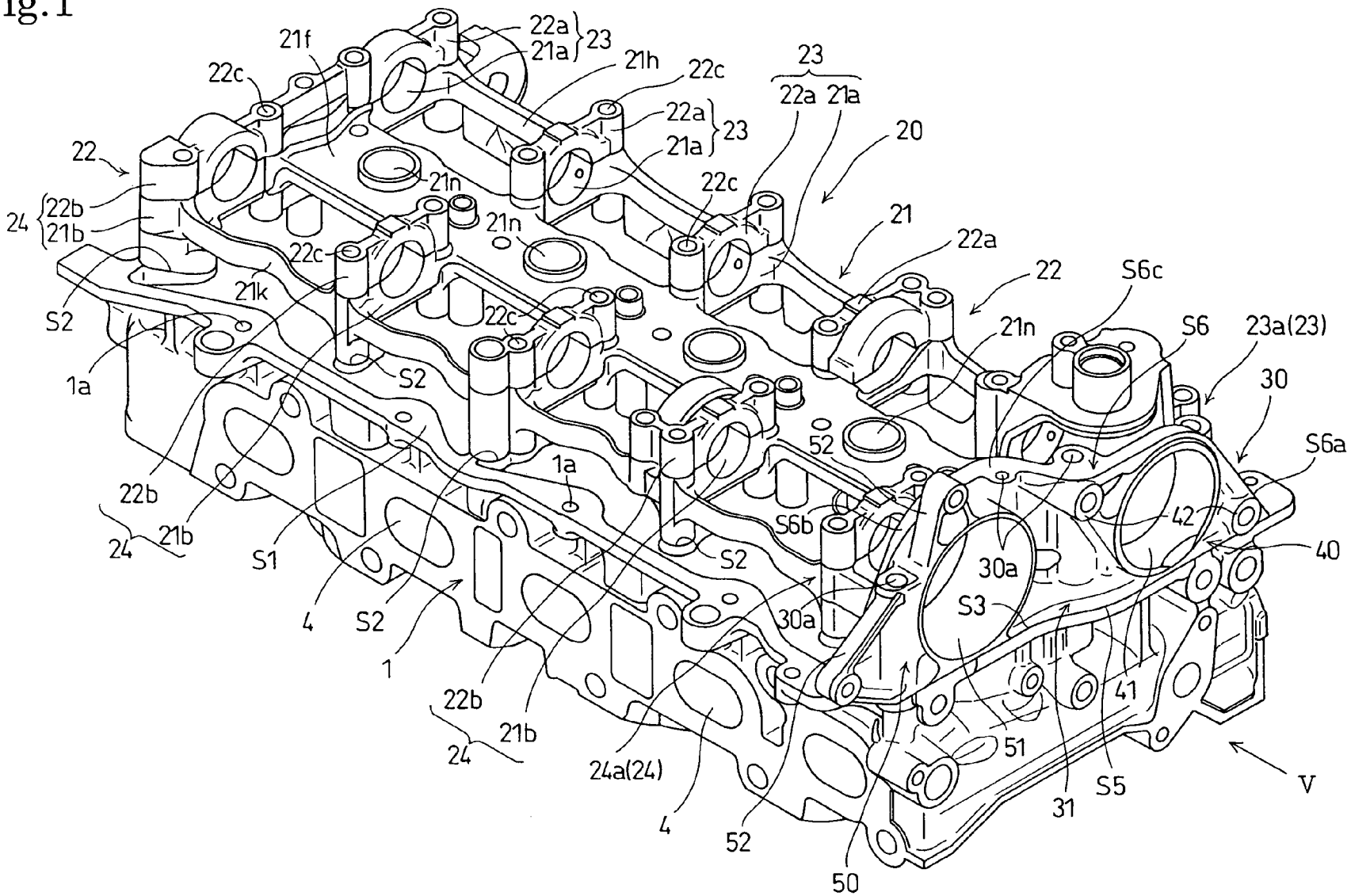
FIG. 1 is a perspective view of a cylinder head of an internal combustion engine to which the present invention is applied.
Figure 2:
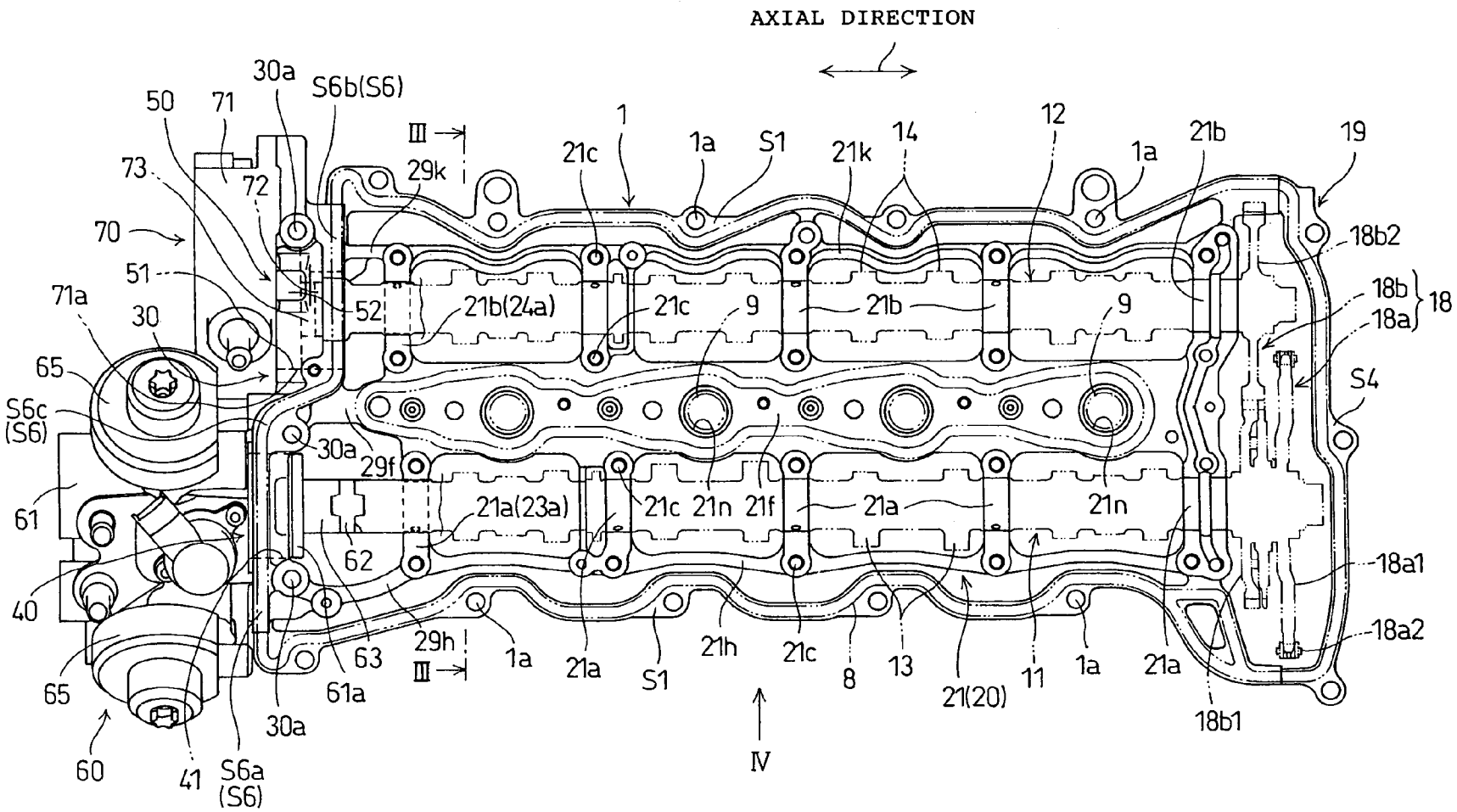
FIG. 2 is a plan view of the cylinder head shown in FIG. 1, provided with a lower camshaft holder, a high-pressure fuel pump and a vacuum pump.
Figure 3:
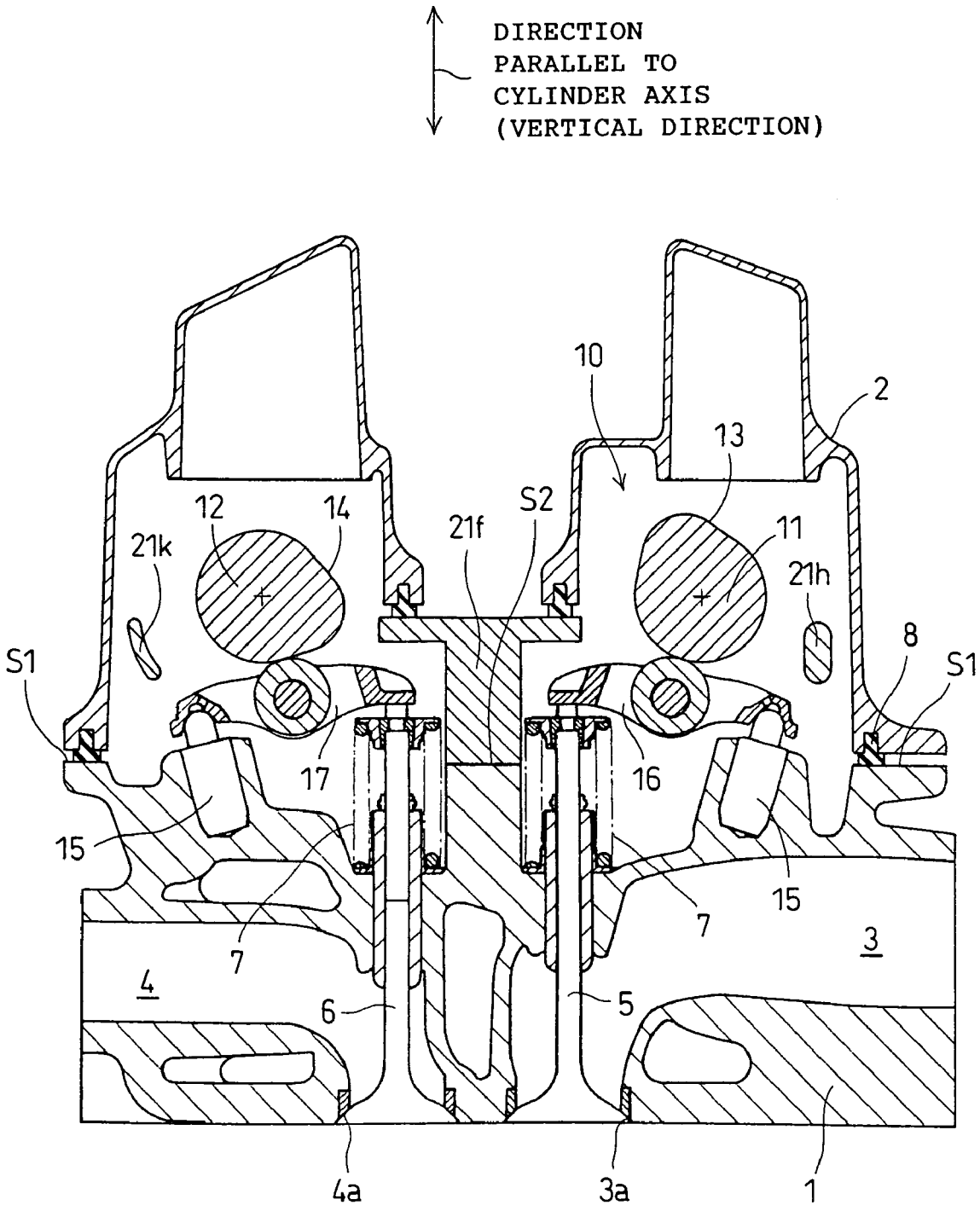
FIG. 3 is a sectional view taken on the line III-III in FIG. 2.
Figure 4:
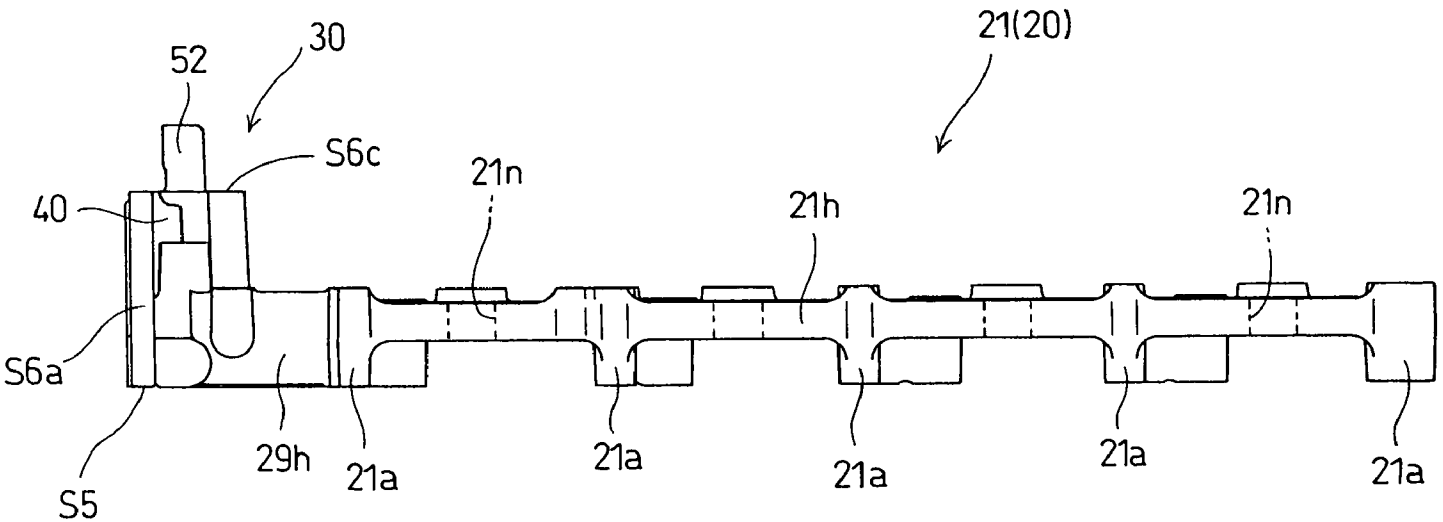
FIG. 4 is a view of the lower camshaft holder taken in the direction of the arrow IV in FIG. 2.

Referring to FIGS. 1 to 3, an internal combustion engine in a preferred embodiment according to the present invention is a compression ignition multicylinder 4-stroke internal combustion engine transversely mounted on a vehicle with its crankshaft transversely extended. The internal combustion engine has a cylinder block, not shown, provided with in-line four cylinders in which pistons each having a recessed combustion chamber in the top thereof, not shown, are fitted for reciprocation to form combustion spaces, respectively, a cylinder head 1 joined to the upper surface of the cylinder block, and a cylinder head cover or valve cover 2 (FIG. 5) joined to the upper surface of the cylinder head 1.

In this embodiment, vertical directions are parallel to the axes of the cylinders, and axial directions are parallel to the center axes of camshafts, which will be described later.

As best shown in FIG. 3, the cylinder head 1 is provided, for each cylinder, with an intake passage 3 having two intake ports 3*a* opening into the combustion space defined by the piston and the cylinder head 1 and an exhaust passage 4 having two exhaust ports 4*a* opening into the combustion space. Fuel injection valves 9 (FIG. 2) are attached to the cylinder head 1 and inserted into the combustion spaces to inject fuel into the combustion chambers. The cylinder head 1 supports, for each cylinder, two intake valves 5 for opening and closing the two intake ports 3*a* and two exhaust valves 6 for opening and closing the two exhaust ports 4*a* so as to be slidable in directions parallel to the axis of the cylinder. The intake valves 5 and the exhaust valves 6 are urged always in a closing direction by valve springs 7, namely, compression coil springs.

A valve train 10 for opening and closing the intake valves 5 and the exhaust valves 6 includes an intake camshaft 11, namely, a first camshaft, rotatably supported on a camshaft holder 20 (FIG. 1) detachably attached to the cylinder head 1 and provided with intake valve control cams 13, an exhaust camshaft 12, namely, a second camshaft, rotatably supported on the camshaft holder 20 and provided with exhaust valve control cams 14, intake rocker arms 16 supported by pivots 15, respectively, on the cylinder head 1 so as to be driven by the intake valve control cams 13, respectively, and exhaust rocker arms 17 supported by pivots 15, respectively, on the cylinder head 1 so as to be driven by the exhaust valve control cams 14, respectively.

The camshafts 11 and 12 are parallel to each other and are driven for rotation by the power of the crankshaft transmitted thereto by a transmission mechanism 18 (FIG. 2). The transmission mechanism 18 is disposed on one axial end of the cylinder head 1 and is covered with a chain cover 19, namely, a transmission cover. The transmission mechanism 18 has a first transmission train 18*a* for transmitting the power of the crankshaft to the intake camshaft 11 and a second transmission train 18*b* interlocking the intake camshaft 11 and the exhaust camshaft 12. The first transmission train 18*a* includes a drive sprocket mounted on the crankshaft, a driven sprocket 18*a*1 mounted on the intake camshaft 11, and a timing chain 18*a*2 extended between the drive sprocket and the driven sprocket 18*a*1. The second transmission train 18*b* includes a drive gear 18*b*1 mounted on the intake camshaft 11 and adjacent to the driven sprocket 18*a*1, and a driven gear 18*b*2 mounted on the exhaust camshaft 12 and meshed with the drive gear 18*b*1. The intake camshaft 11 is driven through the first transmission train 18*a* at a rotational speed equal to half the rotational speed of the crankshaft. The exhaust camshaft 12 is driven through the second transmission train 18*b* by the intake camshaft 11 at a rotational speed equal to that of the intake camshaft 11. The intake valve control cams 13 and the exhaust valve control cams 14 open and close the intake valves 5 and the exhaust valves 6 through the intake rocker arms 16 and the exhaust rocker arms 17, respectively, in synchronism with the rotation of the crankshaft.

The valve train 10 and the camshaft holder 20 of the internal combustion engine are disposed in a valve train chamber R defined by the cylinder head 1 and the valve cover 2. The cylinder head 1 has a joining surface S1 and mounting surfaces S2 and S3, which are flush with each other. The valve cover 2 is fastened to the joining surface S1 with an annular gasket 8 (FIGS. 3 and 5) held between the cylinder head 2 and the joining surface S1 with bolts screwed in threaded holes la (FIGS. 1 and 2) formed in the joining surface S1. The camshaft holder 20 is attached to the mounting surfaces S2. An accessory holder 30 is attached to the mounting surface S3 (FIG. 1). The valve cover 2 is joined to the joining surface S1, the mounting surface S3, and a joining surface S4 formed in the chain cover 19 so as to be flush with the joining surface S1 with the gasket 8 extended over the joining surface S1, the mounting surface S3 and the joining surface S4 to seal the valve train chamber R.

The camshaft holder 20 is provided with a plurality of intake camshaft support parts 23 for rotatably supporting the intake camshaft 11, and a plurality of exhaust camshaft support parts 24 for rotatably supporting the exhaust cam shaft 12. The camshaft holder 20 has a lower camshaft holder 21 (FIG. 4) attached to the mounting surface S2 of the cylinder head 1, and an upper camshaft holder 22 detachably attached to the lower camshaft holder 21. The lower camshaft holder 21 is a frame structure integrally provided with a plurality of bearing parts 23 and 24 respectively including lower bearing parts 21*a* and 21*b*. The upper camshaft holder 22 is a set of a plurality of upper bearing parts 22*a* and 22*b*, namely, camshaft caps, capable of being detachably joined to the lower bearing parts 21*a* and 21*b*, respectively. The camshaft support parts 23 and 24 are axially arranged at intervals. The upper bearing parts 22*a* and 22*b* of each of the camshaft support parts 23 and 24 at each of the opposite ends of the cylinder head 1 are combined in a single member. Bolts are passed through through holes 22*c* and 21*c* formed in the upper bearing parts 22*a* and 22*b* and the lower bearing parts 21*a* and 21*b*, and are screwed into threaded holes formed in the cylinder head 1 to fasten the upper bearing parts 22*a* and 22*b* to the lower bearing parts 21*a* and 21*b* and to fasten the lower camshaft holder 21 to the cylinder head 1. Thus the camshaft holder 20 is attached to the cylinder head 1.

The lower camshaft holder 21 has a straight central frame member 21*f* axially extending in a middle part, with respect to a transverse direction perpendicular to the axial direction, of a space between the camshafts 11 and 12, a straight intake-side frame member 21*h* axially extending opposite to the central frame member 21*f* with respect to the intake camshaft 11, and straight exhaust-side frame member 21*k* extending opposite to the central frame member 21*f* with respect to the exhaust camshaft 12. The frame members 21*f*, 21*h* and 21*k* are axially extending longitudinal frame members. As shown in FIG. 3, parts of the valve cover 2 are joined to parts of the central frame member 21*f* with parts of the gasket 8 held between those parts.

Each of the intake camshaft support parts 23 has transversely opposite ends joined respectively to the central frame member 21*f* and the intake-side frame member 21*h*. Each of the exhaust camshaft support parts 24 has transversely opposite ends joined respectively to the central frame member 21*f* and the exhaust-side frame member 21*k*. The central frame member 21*f* is provided with openings 21*n* having axes aligned with the axes of the cylinders, respectively. The fuel injection valves 9 attached to the cylinder head 1 with their axes extended substantially parallel to those of the cylinders are inserted in the openings 21*n*, respectively.

Figure 5:
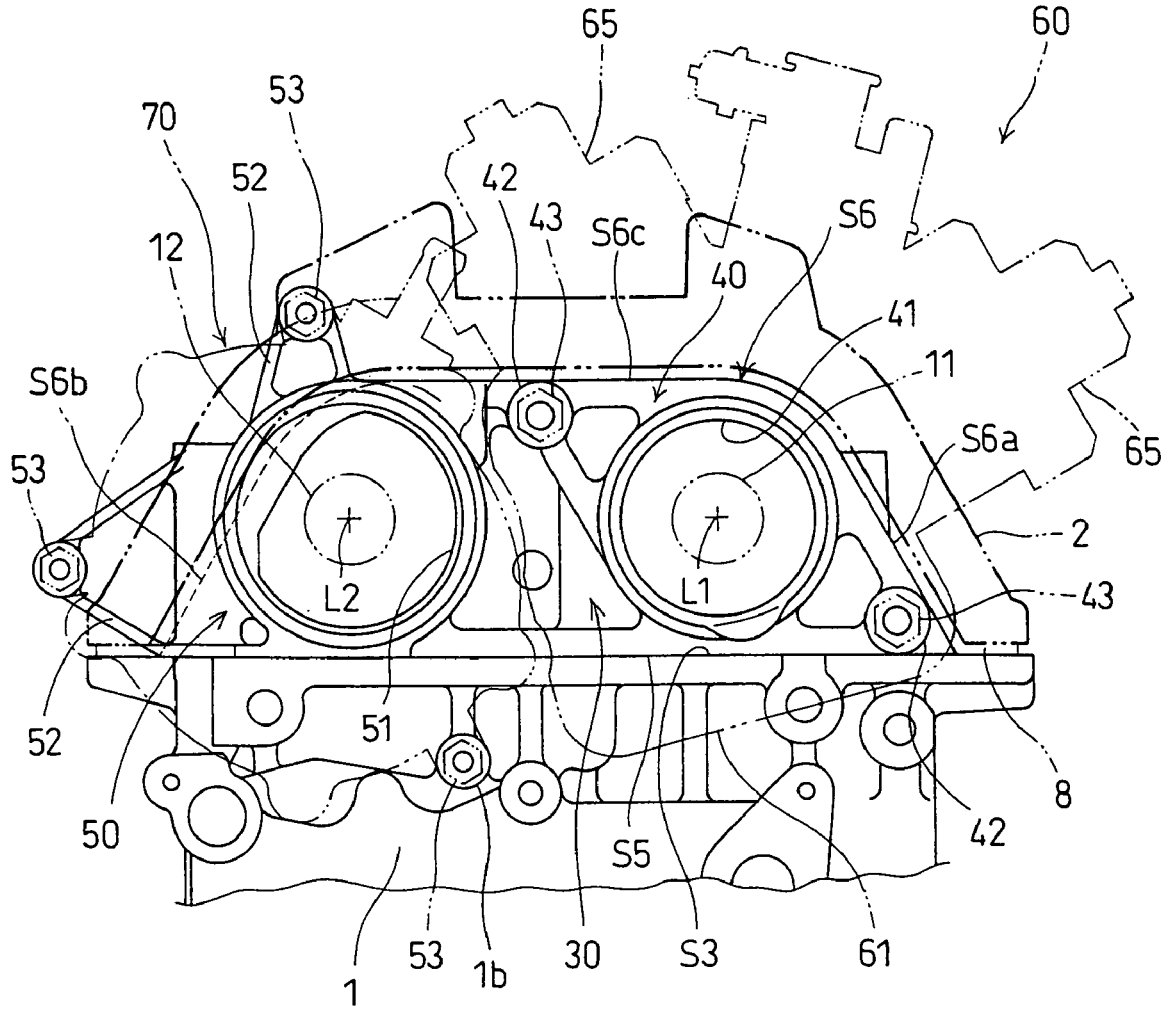
FIG. 5 is a view taken in the direction of the arrow V in FIG. 1.

Referring to FIGS. 2 and 5, a high-pressure fuel pump 60, namely, a first accessory, and a vacuum pump 70, namely, a second accessory, are disposed at one axial end of the cylinder head 1 or the lower camshaft holder 21. The high-pressure fuel pump 60 and the vacuum pump 70 are driven by the intake camshaft 11 and the exhaust camshaft 12, respectively.

Figure 6:
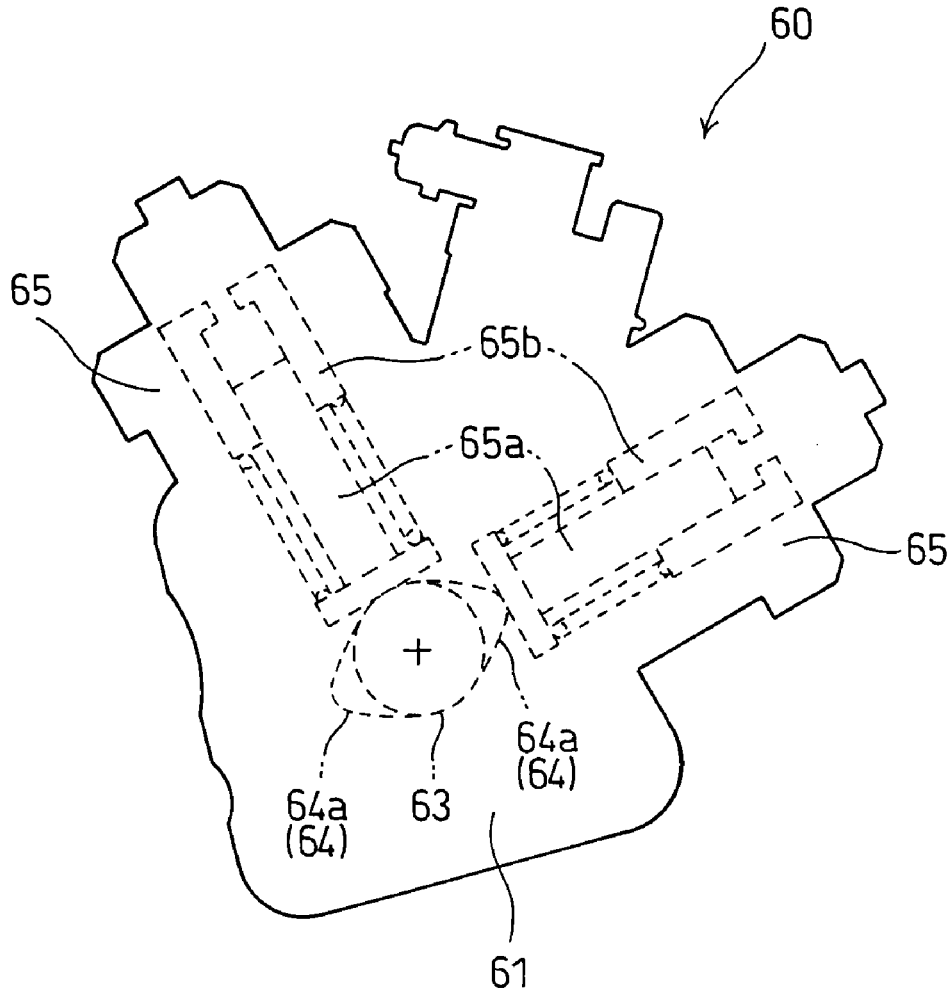
FIG. 6 is a typical view of the high-pressure fuel pump shown in FIG. 2.

Referring to FIG. 6, the high-pressure fuel pump 60 is a positive-displacement fuel pump. The high-pressure fuel pump 60 forces high-pressure fuel into a common rail 4, namely, a pressure fuel accumulator for storing high-pressure fuel to be delivered to the injection valves 9. The high-pressure fuel pump 60 includes a pump housing 61, a driving shaft 63 coaxially connected to the intake camshaft 11 by a shaft coupling 62, a pumping cam 64 mounted on the driving shaft 63, and at least one pump unit (two pump units in this embodiment) 65 having a plunger 65*a* driven by the pumping cam 64, and a barrel 65*b* axially slidably holding the plunger 65*a* therein. The two pump units 65 have axes inclined at 90° to each other. The pumping cam 64 has two cam lobes 64*a*. The phase angle between the two cam lobes 64*a* is 180°. The shaft coupling 62 that rotates together with the intake camshaft 11, and the driving shaft 63 form a first driving mechanism, namely, the driving unit of the high-pressure fuel pump 60.

The number of cycles of the fuel sucking operation of the high-pressure fuel pump 60 and the number of cycles of the fuel discharging operation of the high-pressure fuel pump 60 for each one turn of the intake camshaft 11 is equal to the number of cycles of the intake valve opening operation of the valve train 10 for opening the intake valves 5 (FIG. 3) (or the number of cycles of the intake valve closing operation of the valve train 10 for closing the intake valves 5) for each one turn of the intake camshaft 11. In this embodiment, the number of cycles is four.

Figure 7:
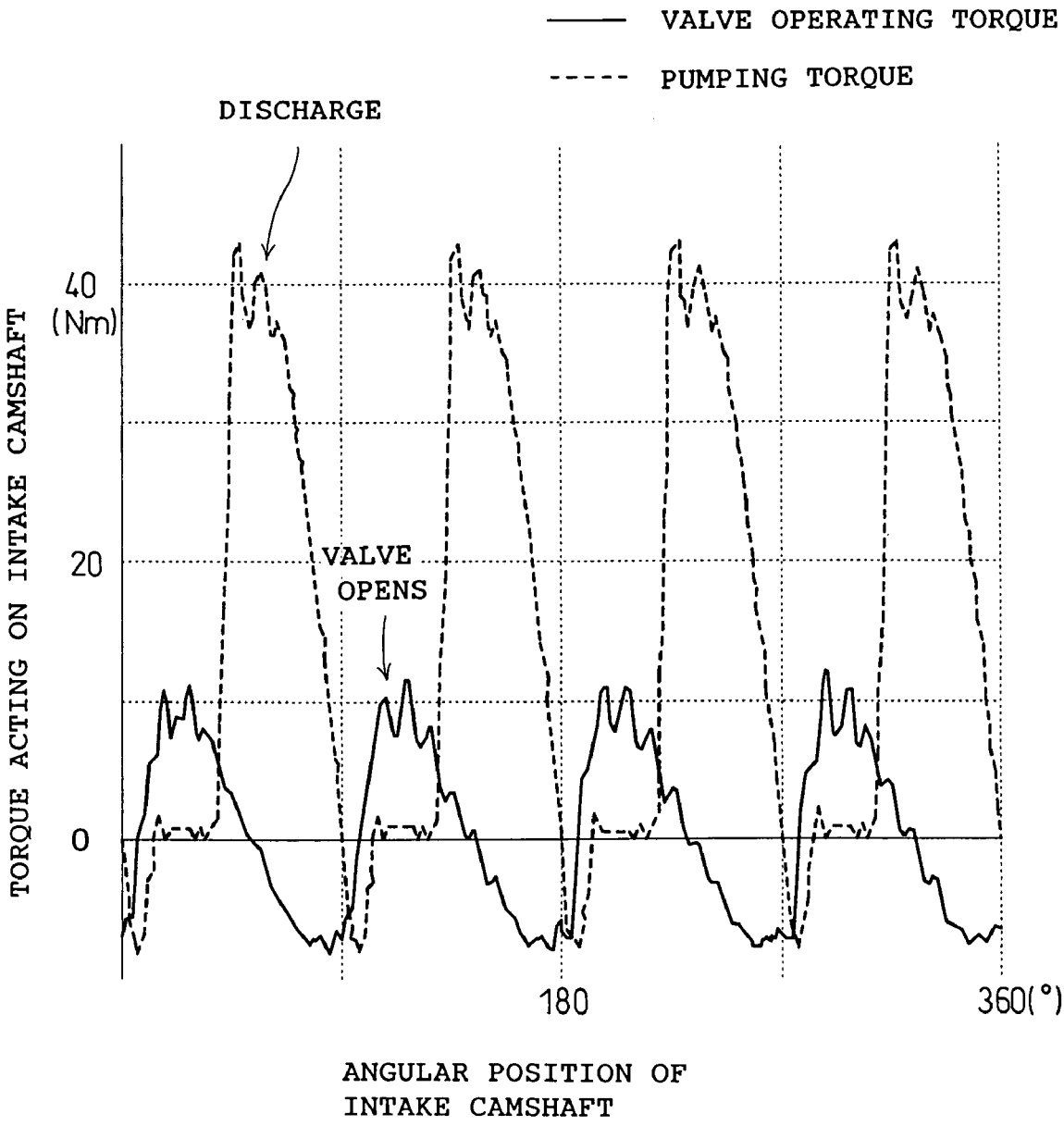
FIG. 7 is a graph showing variation of a valve opening torque acting on the camshaft and a pump driving torque acting on the camshaft with the angular position of the camshaft.

The intake shaft 11 and the driving shaft 63 are connected such that, as shown in FIG. 7, phases of positive peaks in a valve operating torque curve indicating the variation of valve operating torque acting on the intake camshaft 11 when intake camshaft 11 is in a valve opening operation and those of positive peaks in a fuel pump driving torque curve indicating the variation of fuel pump driving torque acting on the intake camshaft 11 when the high-pressure fuel pump 60 is in a fuel discharging operation are separated by a phase angle, and phases of negative peaks in the valve operating torque curve when intake camshaft 11 is in a valve closing operation and those of negative peaks in the fuel pump driving torque curve when the high-pressure fuel pump 60 is in a fuel sucking operation are separated by a phase angle. Thus the amplitude (absolute value) of the torque variation curve indicating the variation of the overall torque acting on the intake camshaft 11 is small as compared with a state where the respective positive peaks of the valve operating torque and the pump driving torque overlap each other, and the respective negative peaks of the valve operating torque and the pump driving torque overlap each other.

The amplitude of the variation of the torque acting on the intake camshaft 11 can be remarkably reduced when the intake camshaft 11 and the driving shaft 63 are connected such that phases of positive peaks in the valve operating torque curve and phases of negative peaks in the fuel pump driving torque curve coincide with each other, and phases of negative peaks in the valve operating torque curve and phases of positive peaks in the fuel pump driving torque curve coincide with each other.

In this embodiment, in which peaks appear four times in the valve operating torque curve and peaks appear four times in the fuel pump driving torque curve while the intake camshaft 11 turns through 360°, a state where one of the intake valve control cams 13 and the pumping cam 64 are in phase is an angular position 0°, the phase angle between the intake valve control cam 13 is 45° (=(360°/4)×50%). When the phase angle is ±22.5° (=±45°×50%) from 45°, the advantageous effect as a result of avoiding coincidence of the peaks can be equally obtained.

Referring to FIGS. 2 and 5, the vacuum pump 70, namely, a rotary pump, includes a pump housing 71, and a driving shaft 73 coaxially connected to the exhaust camshaft 12 by a shaft coupling 72. The shaft coupling 72 that rotates at the same rotational speed as the exhaust camshaft 12, and the driving shaft 73 form a second driving mechanism for driving the vacuum pump 70.

Referring to FIGS. 1, 2, 4 and 5, the high-pressure fuel pump 60 and the vacuum pump 70 are held by the accessory holder 30 disposed at one axial end of the cylinder head 1 or the lower camshaft holder 21.

The accessory holder 30 of the internal combustion engine is formed integrally with an end part of the lower camshaft holder 21 axially nearer to the high-pressure fuel pump 60 and the vacuum pump 70 than the bearing parts 23 and 24 at the axial end. Thus the lower camshaft holder 21 and the accessory holder 30 form a single holding member. The accessory holder 30 formed integrally with the lower camshaft holder 21 is held on the cylinder head 1 by the lower camshaft holder 21.

The accessory holder 30 is a member integrally having a mounting part 31 with a mounting surface S5 (FIG. 1, FIG. 5) which is in face-to-face contact with the mounting surface S3 coplanar with the joining surface S1, first and second mounting seats 40 and 50 erected from the mounting part 31 to form a plurality of mounting seats, and a joining surface S6 to which the valve cover 2 is attached through the gasket 8.

The accessory holder 30 has a shape resembling a flat plate and rises from the joining surface S1. The accessory holder 30 has connecting parts 29*f*, 29*h* and 29*k* (FIG. 2) axially extending from the frame members 21*f*, 21*h* and 21*k*, respectively, and connected to the lower camshaft holder 21. The height of each of the connecting parts 29*f*, 29*h* and 29*k* is higher than the height of each of the frame members 21*f*, 21*h* and 21*k* and is substantially equal to the height of each of the lower bearing parts 21*a* and 21*b*, which are the highest parts of the lower camshaft holder 21. Thus the connecting parts 29*f*, 29*h* and 29*k* have high rigidity.

Referring to FIG. 5, the first mounting seat 40 is provided with an axial first through hole 41 aligned with the center axis L1 of the intake camshaft 11, and two bosses 42 respectively provided with threaded holes and formed respectively on the opposite sides of the first through hole 41. The high-pressure fuel pump 60 is fastened to the first mounting seat 40 by fitting a cylindrical part 61*a* (FIG. 2) of the pump housing 61 thereof in the first through hole 41 and screwing bolts 43 in the threaded holes of the bosses 42.

The second mounting seat 50 is provided with an axial second through hole 51 aligned with the center axis L2 of the exhaust camshaft 12, and two bosses 52 respectively provided with threaded holes and formed near the second through hole 51. The vacuum pump 70 is fastened to the second mounting seat 50 by fitting a cylindrical part 71*a* (FIG. 2) of the pump housing 71 thereof in the second through hole 51 and screwing bolts 53 in the threaded holes of the bosses 52.

The mounting surface S3 and a joining surface S5 are coated with an adhesive sealing liquid to join the cylinder head 1 and the accessory holder 30 closely. A joining surface S6 has transversely opposite ends connected to the joining surface S1, inclined surfaces S6*a* and S6*b* sloping up respectively from the transversely opposite ends and a top surface S6*c* extending above the through holes 41 and 51 and the tops of the mounting seats 40 and 50 and parallel to the joining surface S1. The accessory holder 30 is provided with threaded holes 30*a*. Bolts are screwed in the threaded holes 30*a* to fasten the valve cover 2 to the accessory holder 30. The accessory holder 30, similarly to the cylinder head 1 and the valve cover 2, is one of the walls defining the valve train chamber R (FIG. 3). The cylinder head 1 and the accessory holder 30 have the joining surfaces S1 and S6, respectively. The valve cover 2 is fastened to the cylinder head 1 and the accessory holder 30 with the gasket 8 held between the valve cover 2, and the joining surfaces S1 and S6.

The through holes 41 and 51 lie above the joining surface S1 and the mounting surface S3. The driving shaft 63 axially extending through the cylindrical part 61*a* is inserted into the through hole 41. The driving shaft 63 is connected to the intake camshaft 11 by the shaft coupling 62 at a position between the mounting seat 40 and the bearing part 23*a* in the valve train chamber R. Similarly, the driving shaft 73 axially extending through the cylindrical part 71*a* is inserted into the through hole 51. The driving shaft 73 is connected to the exhaust camshaft 12 by the shaft coupling 72 in the through hole 51.

The operation and effect of the internal combustion engine in the preferred embodiment will be described.

The high-pressure fuel pump 60 and the vacuum pump 70, namely, the accessories for the internal combustion engine, have the driving shafts 63 and 73, respectively. The driving shafts 63 and 73 are connected to the intake camshaft 11 and the exhaust camshaft 12, respectively. The accessory holder 30 provided with the mounting seats 40 and 50 is formed integrally with the camshaft holder 20 attached to the cylinder head 1 and the high-pressure fuel pump 60 and the vacuum pump 70 are fastened to the mounting seats 40 and 50, respectively. The mounting seats 40 and 50 of the accessory holder 30 are provided with the through holes 41 and 51, respectively, and the driving shafts 63 and 73 are inserted into the through holes 41 and 51, respectively. The accessory holder 30 integrally provided with the mounting seats 40 and 50 is formed integrally with the camshaft holder 20 separate from the cylinder head 1. Thus the cylinder head 1 is small and light. Since the accessory holder 30 is supported by the camshaft holder 20 on the cylinder head 1, the accessory holder 30 does not need to be formed in a large size to provide the accessory holder 30 with a high rigidity and has a high rigidity. Thus the accessory holder 30 can stably hold the high-pressure fuel pump 60 and the vacuum pump 70. Since the through holes 41 and 51 are formed respectively in the mounting seats 40 and 50 formed integrally with the accessory holder 30, the through holes 41 and 51, as compared with those formed in split mounting seats, can be easily and reliably sealed.

Since the two mounting seats 40 and 50 are formed integrally with the single accessory holder 30, the rigidity of the accessory holder 30 is higher than that when the mounting seats 40 and 50 are formed on separate members, respectively.

The accessory holder 30 is attached to the mounting surface S3 flush with the joining surface S1 of the cylinder head 1 to which the valve cover 2 is joined. Therefore, the joining surface S1 of the cylinder head 1, to which the valve cover 2 is joined, can be contained in a plane though the accessory holder 30 is supported on the cylinder head 1. Thus the joining surface S1 can be easily finished in high accuracy and hence the joint of the joining surface S1 and the joining surface of the member joined to the joining surface S1 can be sealed at a low cost. Since the mounting surfaces S2 and S3 are flush with the joining surface S1, the joining surface S1 of the cylinder head 1 can be very easily finished.

The accessory holder 30 is formed integrally with the lower camshaft holder 21 integrally provided with the camshaft support parts 23 and 24. Therefore, the accessory holder 30 has a high rigidity and is small and light.

The number of cycles of the fuel discharge operation performed by the high-pressure fuel pump 60 to discharge fuel every one turn of the intake camshaft 11 is equal to the number of cycles of the valve opening operation of the valve train 10, and the intake camshaft 11 and the driving shaft 63 are interlocked such that peaks in the variation of torque acting on the intake camshaft 11 caused by the valve opening operation and peaks in the variation of torque acting on the intake camshaft 11 caused by the discharge operation of the high-pressure fuel pump 60 appear at different phases, respectively. Therefore, a maximum in the amplitude of the torque variation curve indicating the variation of the overall torque acting on the intake camshaft 11 can be reduced. Consequently, the intake camshaft 11 having a necessary rigidity can be formed in a lightweight member.

The cylinder head 1 and the accessory holder 30 have joining surfaces S1 and S6, respectively, the valve cover 2 is joined to the joining surfaces S1 and S6, and a pressure-tight joint is formed by the gasket 8 between the valve cover 2 and the joining surfaces S1 and S2. Therefore, the axial dimension of the cylinder head 1 is small as compared with that of the cylinder head 1 when an accessory holder is disposed outside the joining surface of the cylinder head 1 to which the valve cover 2 is joined.

Characteristic parts of modifications of the foregoing embodiment will be described.

The accessory holder and the camshaft holder may be separate members and the accessory holder may be fastened to the camshaft holder with bolts or such. The high-pressure fuel pump may feed the fuel by pressure directly to the fuel injection valves instead of indirectly feeding the fuel through the common rail to the fuel injection valves.

The internal combustion engine may be provided with only either of the high-pressure fuel pump and the vacuum pump or may be provided with accessories other than the high-pressure fuel pump and the vacuum pump. The driving shaft of the high-pressure fuel pump may be coaxially connected to and driven by the exhaust camshaft The camshafts 11 and 12 or the shaft couplings 63 and 73 may be disposed in the through holes 41 and 51, respectively.

The valve train may be a SOHC type valve train provided with a single camshaft capable of opening and closing both the intake valves and the exhaust valves.

The internal engine may be a spark-ignition internal combustion engine or may be an internal combustion engine for machines other than vehicles, such as an engine included in a marine propulsion device, such as an outboard motor provided with a vertical crankshaft.

What is claimed is:

1. An internal combustion engine comprising:

a cylinder head;

a camshaft holder provided on the cylinder head and rotatably supporting camshaft means included in a valve train for operating engine valves; and accessory means rotatively driven by the camshaft means, wherein the camshaft holder includes a lower camshaft holder and an upper camshaft holder, the lower camshaft holder being a frame structure detachably attached to and extending substantially throughout an upper surface of the cylinder head, the lower camshaft holder having integrally therein a plurality of bearing parts for rotatably supporting therein the camshaft means, the plurality of bearing parts of the lower camshaft holder including a plurality of lower bearing parts arranged at distances in a direction along the camshaft means the upper camshaft holder including a plurality of upper bearing parts detachably mounted to the lower camshaft holder through joining the plurality of upper bearing parts with the plurality of lower bearing parts of the lower camshaft holder, and wherein the accessory means has driving shaft means interlocked with the camshaft means, the camshaft holder being provided with an accessory holder integrally formed with an end part of the lower camshaft holder and having integral mounting seat means to be attached to an upper mounting surface of the cylinder head, the accessory holder being provided with through hole means into which at least either of the camshaft means and the driving shaft means is inserted and supported.

2. The internal combustion engine according to claim 1, wherein the accessory holder is attached to a mounting surface flush with a joining surface of the cylinder head to which a valve cover is joined.

3. The internal combustion engine according to claim 1, wherein the camshaft means includes a first camshaft and a second camshaft, the accessory means include a first accessory and a second accessory, the driving shaft means include a first driving shaft connected to the first camshaft and a second driving shaft connected to the second camshaft, the mounting seat means includes a first mounting seat to which the first accessory is attached and a second mounting seat to which the second accessory is attached, and the through holes means includes a first through hole in which at least one of the first camshaft and the driving shaft is received and a second through hole in which at least one of the second camshaft and the second driving shaft is received.

4. The internal combustion engine according to claim 1, wherein the lower camshaft holder includes a central frame extending along the camshafts means, and two side frames extending along the central frame respectively on the opposite sides of the central frame.

5. The internal combustion engine according to claim 1, wherein the accessory holder is a protrusion having a flat shape.

* * * * *